US008746861B2

(12) United States Patent
Itogawa

(10) Patent No.: US 8,746,861 B2
(45) Date of Patent: Jun. 10, 2014

(54) IMAGE FORMING APPARATUS

(75) Inventor: Yoshihiro Itogawa, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 234 days.

(21) Appl. No.: 13/240,172

(22) Filed: Sep. 22, 2011

(65) Prior Publication Data

US 2012/0081479 A1 Apr. 5, 2012

(30) Foreign Application Priority Data

Sep. 30, 2010 (JP) ..... 2010-221672

(51) Int. Cl.
*B41J 2/175* (2006.01)
*B41J 2/17* (2006.01)
*B41J 29/393* (2006.01)

(52) U.S. Cl.
USPC ..... 347/86; 347/19; 347/84; 347/85

(58) Field of Classification Search
USPC ..... 347/84, 85, 86, 19
See application file for complete search history.

(56) References Cited

U.S. PATENT DOCUMENTS

| | | | | |
|---|---|---|---|---|
| 6,293,648 | B1 * | 9/2001 | Anderson | 347/29 |
| 6,776,467 | B2 * | 8/2004 | Yamazaki et al. | 347/85 |
| 2009/0040262 | A1 | 2/2009 | Watanabe | |
| 2010/0245427 | A1 * | 9/2010 | Shibata | 347/12 |

FOREIGN PATENT DOCUMENTS

| | | | |
|---|---|---|---|
| EP | 1 386 742 | A2 | 2/2004 |
| JP | 57-63285 | | 4/1982 |
| JP | HEI 8-216391 | A | 8/1996 |
| JP | HEI 9-141841 | A | 6/1997 |

OTHER PUBLICATIONS

Extended European Search Report and Opinion dated Nov. 14, 2012 from related European Application No. 11181279.8.
Chinese Office Action dated Dec. 4, 2013 from related Chinese Application No. 201110288727.0, together with an English language translation.

* cited by examiner

*Primary Examiner* — Jannelle M Lebron
(74) *Attorney, Agent, or Firm* — Scully, Scott, Murphy & Presser PC

(57) ABSTRACT

An image forming apparatus is provided. The image forming apparatus includes a liquid cartridge having a plurality of liquid tanks, a cartridge mount, liquid applicators, communication paths to communicably connect the liquid tanks with the liquid applicators, a subsidiary tank arranged in an intermediate position in one of the communication paths, a first remaining amount detector to detect amounts of liquids remaining in the liquid tanks, a first liquid conveyer to transfer the liquid from the communicably connected liquid tank to the subsidiary tank, and a first liquid conveyer controller to manipulate the first liquid conveyer. When an amount of one of the liquids remaining in one of the liquid tanks is smaller than a first predetermined amount, the first liquid conveyer controller manipulates the first liquid conveyer to transfer the other of the liquids remaining in the other of the liquid tanks to the subsidiary tank.

16 Claims, 8 Drawing Sheets

IMAGE FORMING APPARATUS

CROSS REFERENCE TO RELATED APPLICATION

This application claims priority from Japanese Patent Applications No. 2010-221672, filed on Sep. 30, 2010, the entire subject matter of which is incorporated herein by reference.

BACKGROUND

1. Technical Field

An aspect of the present invention relates to an image forming apparatus having a liquid cartridge, in which a plurality of liquid tanks are integrally formed.

2. Related Art

An image forming apparatus, which forms images on a recording medium by ejecting liquid of a first type (e.g., ink) onto a surface of the recording medium, is known. In the image forming apparatus, liquid of a second type (e.g., a process agent), which causes specific components in the first-typed liquid to condense or deposit, may be applied to the surface of the recording medium in order to improve image-forming quality and maintain appearance of the formed images. When the first-typed liquid and the second-typed liquid are contained independent containers separately, however, rooms to store the independent containers are required in the image forming apparatus. As a result, a volume of the image forming apparatus may become larger.

In order to reduce the volume of the image forming apparatus, therefore, a single container with a plurality of integrally-formed compartments to store the different-typed liquids separately may be suggested.

SUMMARY

The liquid container with the compartments may require a smaller room in the image forming apparatus, and when one of the first-typed and second-typed liquids is exhausted, the entire container may be replaced with a new container even when the other of the different typed liquids remains in the container. Therefore, the other of the different typed liquids remaining in the replaced container may be wasted.

In view of the above drawbacks, the present invention is advantageous in that an image forming apparatus, which has a liquid cartridge with a plurality of integrally-formed compartments, and in which an amount of liquid to be wasted can be reduced when liquid cartridges are exchanged, is provided.

According to an aspect of the present invention, an image forming apparatus to form an image in a plurality of different-typed liquids is provided. The image forming apparatus includes a liquid cartridge, which is configured to have a plurality of liquid tanks to respectively contain the different-typed liquids, a cartridge mount, on which the liquid cartridge is mounted, a plurality of liquid applicators, which are configured to apply the different-typed liquids respectively to form the image on a recording medium, a plurality of communication paths, which are configured to communicably connect the liquid tanks with the liquid applicators respectively to be in fluid communication with each other, a subsidiary tank, which is arranged in an intermediate position in one of the communication paths to be communicably connected with one of the liquid tanks, to store one of the different-typed liquids conveyed from the communicably connected the liquid tank, a first remaining amount detector, which is configured to detect amounts of the different-typed liquids remaining in the liquid tanks, a first liquid conveyer, which is configured to transfer the different-typed liquid from the communicably connected liquid tank to the subsidiary tank, and a first liquid conveyer controller, which is configured to manipulate the first liquid conveyer. When the first remaining amount detector detects an amount of one of the different-typed liquids remaining in one of the liquid tanks being smaller than a first predetermined amount, the first liquid conveyer controller manipulates the first liquid conveyer to transfer the other of the different-typed liquids remaining in the other of the liquid tanks, which is communicably connected with the subsidiary tank, to the subsidiary tank.

According to another aspect of the present invention, an image forming apparatus to form an image in a plurality of different-typed liquids is provided. The image forming apparatus includes a liquid cartridge, which is configured to have a plurality of liquid tanks to respectively contain the different-typed liquids, a cartridge mount, on which the liquid cartridge is mounted, a plurality of liquid applicators, which are configured to apply the different-typed liquids respectively to form the image on a recording medium, a plurality of communication paths, which are configured to communicably connect the liquid tanks with the liquid applicators respectively to be in fluid communication with each other, a subsidiary tank, which is arranged in an intermediate position in one of the communication paths to be communicably connected with one of the liquid tanks, to store one of the different-typed liquids conveyed from the communicably connected the liquid tank, a processor, which is configured to control behaviors of the image forming apparatus, a non-transitory computer readable medium containing instructions, which cause the processor to function, when executed by the processor, as a first remaining amount detector, which is configured to detect amounts of the different-typed liquids remaining in the liquid tanks, a first liquid conveyer, which is configured to transfer the different-typed liquid from the communicably connected liquid tank to the subsidiary tank, and a first liquid conveyer controller, which is configured to manipulate the first liquid conveyer. When the first remaining amount detector detects an amount of one of the different-typed liquids remaining in one of the liquid tanks being smaller than a first predetermined amount, the first liquid conveyer controller manipulates the first liquid conveyer to transfer the other of the different-typed liquids remaining in the other of the liquid tanks, which is communicably connected with the subsidiary tank, to the subsidiary tank.

BRIEF DESCRIPTION OF THE ACCOMPANYING DRAWINGS

DETAILED DESCRIPTION

Hereinafter, embodiments of the present invention will be described with reference to the accompanying drawings.

First Embodiment

Overall Configuration of Ink-Jet Printer

Figure 1:
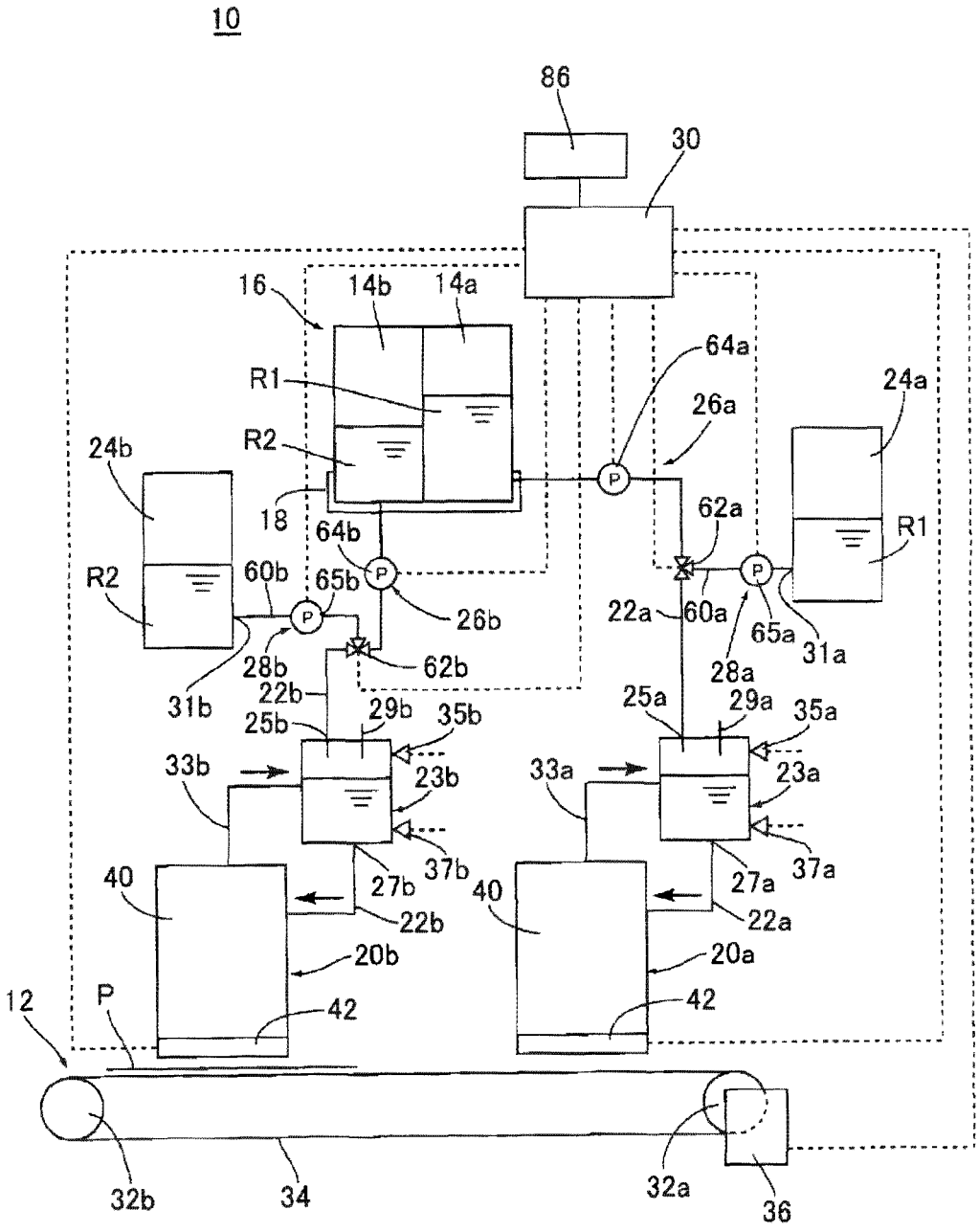
FIG. 1 is a diagram to illustrate an internal configuration of an ink-jet printer according to a first embodiment of the present invention.

An overall configuration of an ink-jet printer 10 according to a first embodiment will be described with reference to FIG. 1. The ink-jet printer 10 is a line printer, which prints lines of images on a surface of a sheet P of paper being a recording medium, by ejecting liquids R1, R2 of different types onto the surface of the sheet P as the sheet P is conveyed by a conveyer unit 12. The liquids R1, R2 are respectively stored in liquid tanks 14*a*, 14*b*, which are compartments integrally formed in a liquid cartridge 16. The liquid cartridge 16 is mounted on a cartridge mount 18 to be movable along with the cartridge mount 18. Further, the ink-jet printer 10 includes a plurality of (e.g., two) liquid applicators 20*a*, 20*b*, which applies the liquids R1, R2 to form the lines of images, and a plurality of (e.g., two) communication paths 22*a*, 22*b*, which communicably connect the liquid tanks 14*a*, 14*b* with the ink applicators 20*a*, 20*b* respectively.

The ink-jet printer 10 includes at least one subsidiary tank 23*a*/23*b* in an intermediate position in one of the communication paths 22*a*, 22*b*. In the present embodiment, two subsidiary tanks 23*a*, 23*b*, which temporarily store the liquids R1 R2 conveyed from the liquid tanks 14*a*, 14*b* toward the ink applicators 20*a*, 20*b* respectively, are arranged in intermediate positions in the communication paths 22*a*, 22*b*. Further, the ink-jet printer 10 includes at least one reserve tank 24*a*/24*b*, which is arranged to be in communication with one of the liquid tanks 14*a*, 14*b*, to store one of the liquids R1, R2. In the present embodiment, two reserve tanks 24*a*, 24*b*, which are in communication with the liquid tanks 14*a*, 14*b* respectively, are provided to temporarily store the liquids R1, R2. Furthermore, the ink-jet printer 10 includes first liquid conveyers 26*a*, 26*b*, which carry the liquids R1, R2 from the liquid tanks 14*a*, 14*b* to the subsidiary tanks 23*a*, 23*b*, and second liquid conveyers 28*a*, 28*b*, which carry the liquids R1, R2 from the liquid tanks 14*a*, 14*b* to the reserve tanks 24*a*, 24*b*. The ink-jet printer 10 is provided with a controller unit 30, which controls overall behaviors of the components in the ink-jet printer 10.

Configuration of Conveyer Unit

The conveyer unit 12 carries the sheet P stored in a sheet cassette (not shown) toward a position in the vicinity of the liquid applicators 20*a*, 20*b*. The conveyer unit 12 includes a pair of pulleys 32*a*, 32*b*, an endless belt 34, which encircles to roll around the pulleys 32*a*, 32*b*, and a motor 36 to drive the pulley 32*a*. The motor 36 is electrically connected with the controller unit 30 via one of conductive wires, which are indicated in broken lines in FIG. 1. The motor 36 is, for example, a stepping motor, and a rotation rate of the motor 36 is controlled by the controller unit 30 to adjust a speed of conveying the sheet P. Meanwhile, in positions above an upper surface of the endless belt 34, the liquid applicators 20*a*, 20*b* are arranged in line along a sheet-conveying direction. The sheet P is carried to the endless belt 34 and is conveyed on the upper surface of the endless belt 34 to pass under the liquid applicator 20*b* and the liquid applicator 20*a*.

Configuration of Liquid Cartridge

The liquid cartridge 16 includes a first liquid tank 14*a*, in which the liquid R1 is stored, and a second liquid tank 14*b*, in which the liquid R2 is stored. The first liquid tank 14*a* and the second liquid tank 14*b* are compartments integrally formed in the liquid cartridge 16, and the liquid cartridge 16 is detachably attached to the cartridge mount 18. In the present embodiment, the liquids R1, R2 of different types are an ink in a color (e.g., black) and a process agent for the ink. Therefore, in the following description, the liquids R1, R2 may be referred to as the ink R1 and the process agent R2 respectively.

The process agent R2 serves to cause components in the ink R1 to condense or precipitate. For example, when the ink R1 is a pigment ink, the process agent R2 aids the colorant in the ink R1 to condense. For another example, when the ink R1 is a dye ink, the process agent R2 aids colorant in the ink R1 to precipitate. Materials for the process agent R2 may be, for example, cationic compound and selectable from liquids containing multivalent metal salt such as cationic polymers, cationic surfactant, calcium salt, and magnesium salt. The process agent R2 is applied to a surface area of the sheet P prior to application of the ink R1. When the ink R1 is applied to the surface area, on which the process agent R2 has been applied, the multivalent metal salt affects the pigment in the ink R1 to condense or the dye in the ink R1 to precipitate to form insoluble or hardly-soluble metallic composite. As a result, permeability of the ink R1 into the sheet P is lessened, and the ink R1 tends to remain on the surface of the sheet P and to maintain its appearance.

Configuration of Liquid Applicators

The liquid applicators 20*a*, 20*b* serve to form images on the sheet P by using the different-typed liquids, which are the ink R1 and the process agent R2. The liquid applicators 20*a*, 20*b* use the liquids R1, R2 to directly and indirectly form the images. More specifically, in the present embodiment, the liquid applicator 20*a* directly serves to form the images by ejecting the ink R1, whilst the liquid applicator 20*b* indirectly serves to form the images by ejecting the process agent R2. In the following description, the liquid applicators 20*a*, 20*b* may be referred to as an ink-jet head 20*a*, and an agent-jet head 20*b* respectively.

The ink-jet head 20*a* ejects the ink R1 onto the sheet P whilst the sheet P is conveyed in the sheet-feeding direction by the conveyer unit 12. The ink-jet head 20*a* includes a hexahedral-shaped head holder 40, one of whose six planes faces downward to face the sheet P. The head holder 40 is arranged to have longer edges of the downward plane thereof to align in parallel with a main scanning direction of the ink-jet printer 10. The main scanning direction is a direction orthogonal to the sheet-feeding direction, and the ink-jet head 20*a* is moved along the main scanning direction to scan the sheet P. Meanwhile, the sheet-feeding direction may be referred to as an auxiliary scanning direction. On the downward surface of the head holder 40 is arranged a head 42, from which the ink R1 is ejected.

Figure 2:
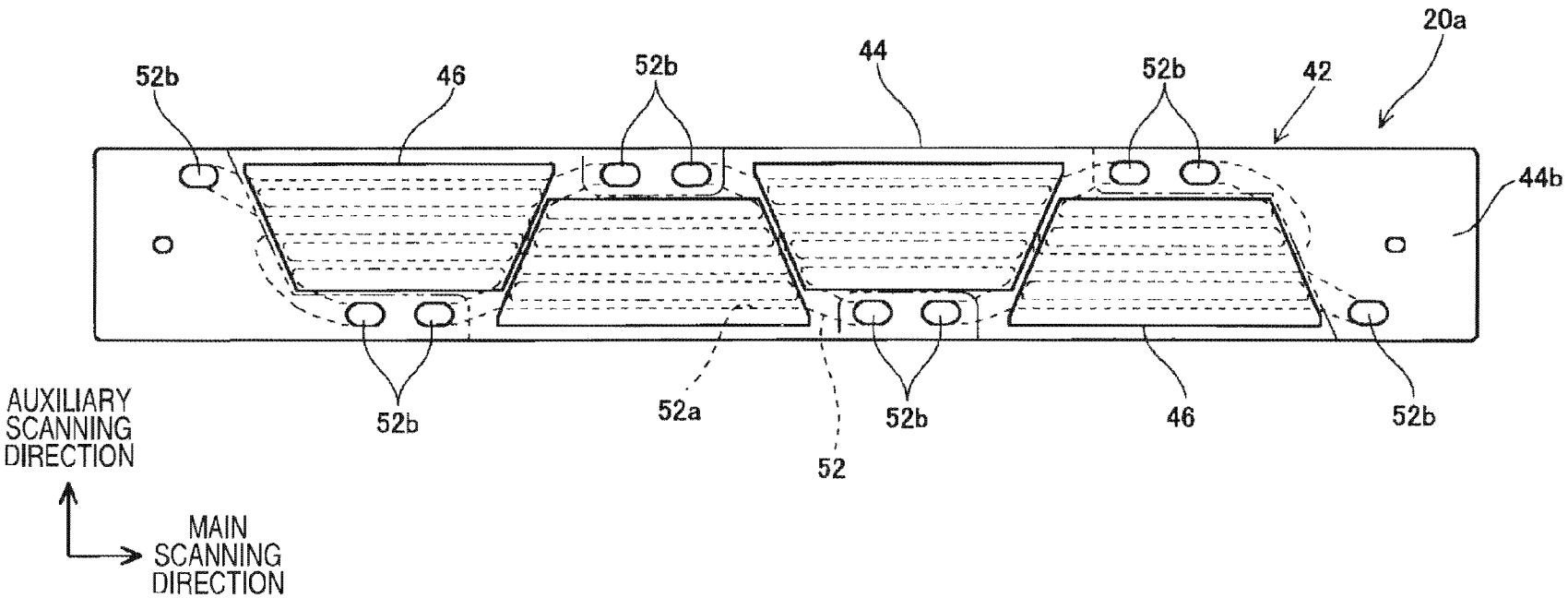
FIG. 2 is a plane view of an ink-jet head in the ink-jet printer according to the first embodiment of the present invention.
Figure 3:
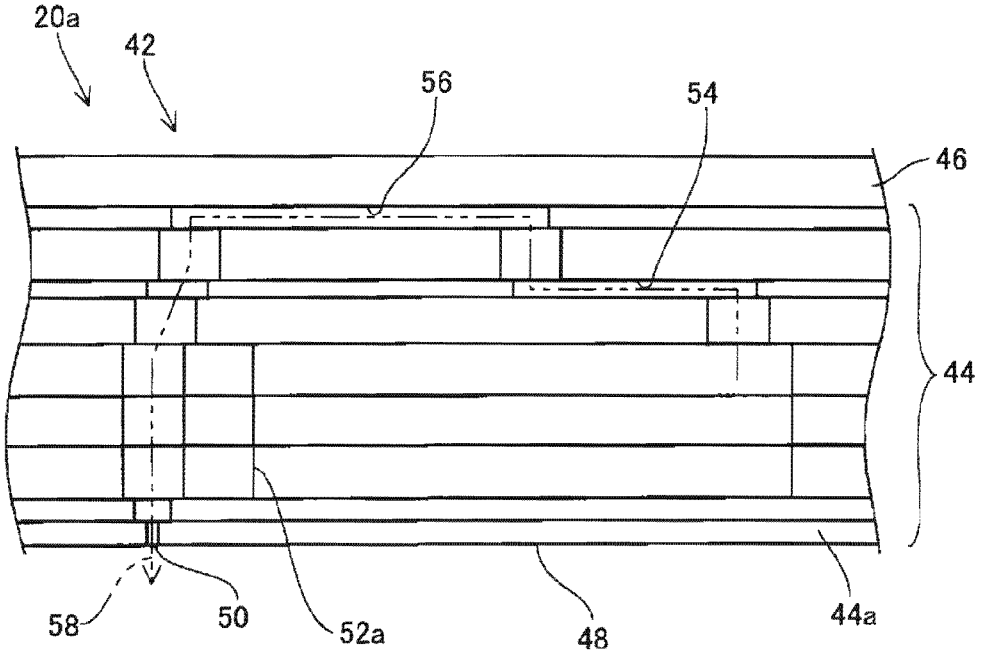
FIG. 3 is a cross-sectional partial view of the ink-jet head in the ink-jet printer according to the first embodiment of the present invention.

The head 42 includes a fluid channel unit 44 in a lower section and an actuator unit 46 attached on top of the fluid channel unit 44 (see FIG. 3). The fluid channel unit 44 includes a plurality of laminated metal (e.g., stainless steel) plates, and a lower surface of a lowermost nozzle plate 44*a* amongst the laminated metal plates serves as a nozzle surface 48. The nozzle plate 44*a* is formed to have a plurality of holes being nozzles 50 on the nozzle surface 48. The nozzles 50 align in parallel with the main scanning direction, when the ink-jet head 20*a* is installed in the ink-jet printer 10, and are arranged to eject the ink R1 along the main scanning direction at intervals of 600 dpi (dot per inch). In the fluid channel unit 44, manifolds 52 (see FIG. 2) and subsidiary manifolds 52*a* are formed. Further, in the fluid channel unit 44, a plurality of ink channels 58 to introduce the ink R1 from the subsidiary manifolds 52 to the nozzles 50 through apertures 54 and pressure chambers 56 are formed. On a top surface 44*b* of the fluid channel unit 44, a plurality of ink supply holes 52*b*, which are in fluid communication with the manifolds 52, are formed. The ink supply holes 52*b* are in communication with a reserve unit (not shown), which is arranged in an upper position with respect to the head 42, and the ink supply holes 52*b* are connected with the liquid tank 14*a* in the liquid cartridge 16 via a communication path 22 (see FIG. 1).

The actuator unit 46 includes a plurality of actuators (not shown), each of which is provided for each of the ink channels 58. Each actuator has a pair of electrodes and a piezoelectric layer interposed between the electrodes. As electric voltage is applied to the electrodes, the piezoelectric layer is deformed, and the deformation applies pressure to the ink R1 in the pressure chamber 56. Therefore, the ink R1 in the pressure chamber 56 is moved to be ejected out of the nozzle 50. Each of the electrodes is electrically connected with one end of a flexible printed circuit (FPC) having a driver-integrated circuit (IC). The other end of the FPC is electrically connected to the controller unit 30. In the present embodiment, resolutions of the ink-jet head 20*a* along the main scanning direction and along the auxiliary scanning direction are both 600 dpi. As the controller unit 30 controls the actuator unit 46 to eject the ink R1 in dots through the nozzles 50, the dots are arranged at an interval of 600 dpi along the auxiliary scanning direction. That is, a printable area on the surface of the sheet P is partitioned into grid-arranged unit areas, each of which is 1/600 inch by 1/600 inch in the main scanning direction and in the auxiliary scanning direction.

The agent-jet head 20*b* arranged in an upstream position with respect to the ink-jet head 20*a* in the sheet-feeding direction ejects the process agent R2 onto the sheet P whilst the sheet P is conveyed in the sheet-feeding direction by the conveyer unit 12. The agent-jet head 20*b* is configured similarly to the ink-jet head 20*a* except the liquid tank 14*b* being attached to the head 42 via the reserve unit and the process agent R2 being stored in the liquid tank 14*b*. The components in the agent-jet head 20*b* similar to those in the ink-jet head 20*a* will be referred to by the same names and the same reference signs in the following description.

The actuator unit 46 in the agent-jet head 20*b* includes a plurality of actuators (not shown), each of which is provided for each of agent channels (not shown). Each actuator has a pair of electrodes and a piezoelectric layer interposed between the electrodes. Each of the electrodes is electrically connected with one end of an FPC having a driver IC. The other end of the FPC is electrically connected to the controller unit 30. The resolutions of the agent-jet head 20*b* along the main scanning direction and along the auxiliary scanning direction are both 600 dpi. In this regard, the controller unit 30 controls the actuator unit 46 to eject the process agent R2 in dots through the nozzles 50 at the interval of 600 dpi along the auxiliary scanning direction so that the dots of process agent R2 are placed in the same grid-arranged unit areas. In order to eject the dots of ink R1 and the process agent R2 in the same positions so that the separately ejected ink R1 and the process agent R2 overlap in the same unit areas on the sheet P, the ink-jet head 20*a* and the agent-jet head 20*b* are arranged in same positional condition (e.g., in terms of distance, ejecting angles, etc.) with respect to the sheet P.

Communication Paths

The communication path 22*a* (FIG. 1) is a channel for the ink R1 to flow from the liquid tank 14*a* to the ink-jet head 20*a* and may be, for example, a flexible tube. The subsidiary tank 23*a* is arranged in the intermediate position in the communication path 22*a* to divide the communication path 22*a* into an upstream section and a downstream section. At an intermediate position in the upstream section in the communication path 22*a*, a branch path 60*a* diverges from the communication path 22*a* and is connected to a port 31*a* formed in the reserve tank 24*a* at the other end. Therefore, the reserve tank 24*a* is connected with the communication path 22*a* via the branch path 60*a* to be in fluid communication with the liquid tank 14*a*. The upstream section of the communication path 22*a* connects an inlet 25*a* of the subsidiary tank 23*a* and an outlet (not signed) of the liquid tank 14*a*. Meanwhile, the downstream section of the communication path 22*a* connects an outlet 27*a* of the subsidiary tank 23*a* and an inlet (not signed) of the ink-jet head 20*a*. A room inside the subsidiary tank 23*a* is in communication with atmosphere via a valve 29*a*. In a branch point in the communication path 22*a*, at which the branch path 60*a* diverges from the communication path 22*a*, a switch valve 62*a* to switch the flows of the ink R1 is provided. In an intermediate position in the upstream section in the communication path 22*a*, a pump 64*a* to convey the ink R1 from the liquid tank 14*a* is provided. Furthermore, in an intermediate position in one of the upstream section in the communication path 22*a* with respect to the switch valve 62*a* and the branch path 60*a*, a pump 65*a* is provided. In the present embodiment, the pump 65*a* is arranged in the intermediate position in the branch path 60*a*. The switch valve 62*a*, the pumps 64*a*, 65*a* are electrically connected with the controller unit 30 via conducting wires, which are indicated in broken lines in FIG. 1, to be controlled by the controller unit 30.

The communication path 22*b* is a channel for the process agent R2 to flow from the liquid tank 14*b* to the agent-jet head 20*b* and may be, for example, a flexible tube. The subsidiary tank 23*b* is arranged in an intermediate position in the communication path 22*b* to divide the communication path 22*b* into an upstream section and a downstream section. At an intermediate position in upstream section in the communication path 22*b*, a branch path 60*b* diverges from the communication path 22*b* is connected to a port 31*b* formed in the reserve tank 24*b* at the other end. Therefore, the reserve tank 24*b* is connected with the communication path 22*b* via the branch path 60*b* to be in fluid communication with the liquid tank 14*b*. The upstream section of the communication path 22*b* connects an inlet 25*b* of the subsidiary tank 23*b* and an outlet (not signed) of the liquid tank 14*b*. Meanwhile, the downstream section of the communication path 22*b* connects an outlet 27*b* of the subsidiary tank 23*b* and an inlet (not signed) of the agent-jet head 20*b*. A room inside the subsidiary tank 23*b* is in communication with atmosphere via a valve 29*b*. In a branch point in the communication path 22*b*, at which the branch path 60*b* diverges from the communication path 22*b*, a switch valve 62*b* to switch the flows of the process agent R2 is provided. In an intermediate position in the upstream section in the communication path 22*b* a pump 64*b* to convey the process agent R2 from the liquid tank 14*b* is provided. Furthermore, in an intermediate position in one of the upstream section in the communication path 22*b* with respect to the switch valve 62*b* and the branch path 60*b*, a pump 65*b* is provided. In the present embodiment, the pump 65*b* is arranged in the intermediate position in the branch path 60*b*. The switch valve 62*b*, the pumps 64*b*, 65*b* are electrically connected with the controller unit 30 via conducting wires, which are indicated in broken lines in FIG. 1, to be controlled by the controller unit 30.

The subsidiary tanks 23*a*, 23*b* temporarily store the ink R1 and the process agent R2 conveyed from the liquid tanks 14*a*, 14*b* respectively, and air bubbles contained in the ink R1 and the process agent R2 are removed in the subsidiary tanks 23*a*, 23*b*. Liquid capacity of the subsidiary tanks 23*a*, 23*b* for the liquids R1, R2 is smaller than capacities of the liquid tanks 14*a*, 14*b* and the reserve tanks 24*a*, 24*b*. The reserve tanks 24*a*, 24*b* temporarily store the ink R1 and the process agent R2 conveyed from the liquid tanks 14*a*, 14*b* respectively. The liquid capacity of the reserve tanks 24*a*, 24*b* is equivalent to the liquid capacity of the liquid tanks 14*a*, 14*b*, which are connected to the reserve tanks 24*a*, 24*b* respectively.

In the present embodiment, in order to remove the air bubbles from the ink R1 in the ink-jet head 20*a*, the subsidiary tank 23*a* and the ink-jet head 20*a* are in communication with each other via circulation paths 33*a*, and the ink R1 is circulated between the subsidiary tank 23*a* and the ink-jet head 20*a* by a circulator (not shown) such as a pump. In the subsidiary tank 23*a*, an upper level sensor 35*a* and a lower level sensor 37*a*, which detect a liquid level of the ink R1 in the subsidiary tank 23*a*, are provided in order to monitor and maintain the level of the ink in the subsidiary tank 23*a* within an upper limit and a lower limit. Similarly, the subsidiary tank 23*b* and the agent-jet head 20*b* are in communication with each other via circulation paths 33*b* to circulate the process agent R2. In the subsidiary tank 23*b*, an upper level sensor 35*b* and a lower level sensor 37*b* to monitor a level of the process agent R2 in the subsidiary tank 23*b* are provided.

First liquid conveyers 26*a*, 26*b* convey the ink R1 and the process agent R2 from the liquid tanks 14*a*, 14*b* to the subsidiary tanks 23*a*, 23*b* respectively and include the switch valves 62*a*, 62*b*, the pumps 64*a*, 64*b*, and the controller unit 30. When the controller unit 30 manipulates the switch valves 62*a*, 62*b*, the flow paths for the liquids R1, R2 to flow from the liquid tanks 14*a*, 14*b* to the subsidiary tanks 23*a*, 23*b* become open. Further, when the controller unit 30 manipulates the pumps 64*a*, 64*b*, the liquids R1, R2 are conveyed from the liquid tanks 14*a*, 14*b* to the subsidiary tanks 23*a*, 23*b*.

Second liquid conveyers 28*a*, 28*b* convey the ink R1 and the process agent R2 from the liquid tanks 14*a*, 14*b* to the reserve tanks 24*a*, 24*b* respectively and include the switch valves 62*a*, 62*b*, the pumps 65*a*, 65*b*, and the controller unit 30. When the controller unit 30 manipulates the switch valves 62*a*, 62*b*, the flow paths for the liquids R1, R2 to flow from the liquid tanks 14*a*, 14*b* to the reserve tanks 24*a*, 24*b* become open. Further, when the controller unit 30 manipulates the pumps 65*a*, 65*b*, the liquids R1, R2 are conveyed from the liquid tanks 14*a*, 14*b* to the reserve tanks 24*a*, 24*b*.

Controller Unit

Figure 4:
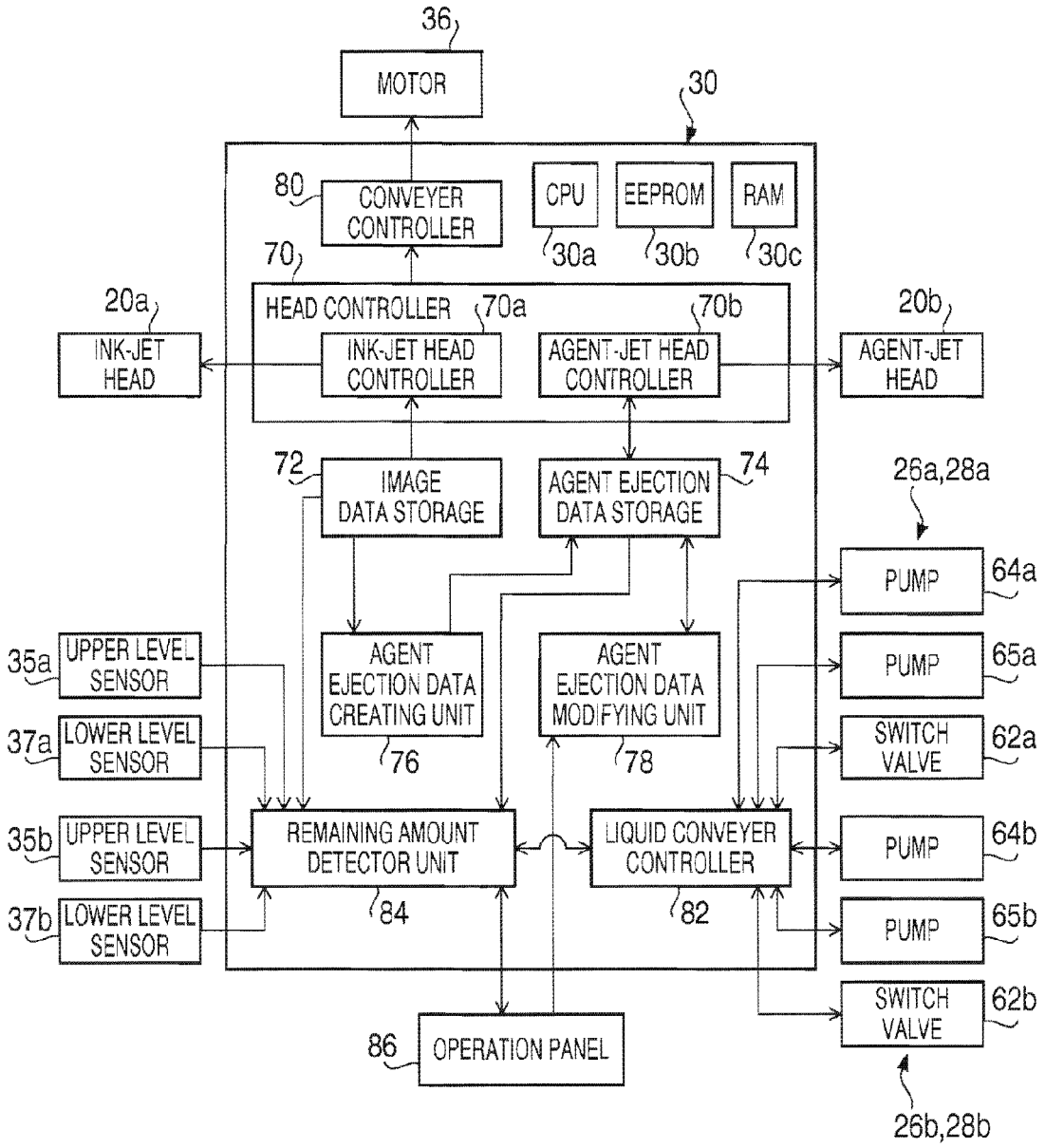
FIG. 4 is a block diagram to illustrate configuration of a controller unit in the ink-jet printer according to the first embodiment of the present invention.

Configuration of the controller unit 30 in the ink-jet printer 10 according to the present embodiment will be described with reference to FIG. 4. The controller unit 30 includes a central processing unit (CPU) 30*a*, an electrically erasable and programmable read only memory (EEPROM) 30*b*, and a random access memory (RAM) 30*c*, which are connected with other and with each of the components in the controller unit 30 described below (conductive lines to indicate the connection are omitted in FIG. 4). The CPU 30*a* executes arithmetic operations, and the EEPROM 30*b* is a rewritable memory to store controlling programs and instructions to be executed by the CPU 30*a* and data to be used in the controlling programs. The RAM 30*c* temporarily stores data to be used in the controlling programs when the programs are active. According to the controlling programs, the CPU 30*a* manipulates a head controller 70, an image data storage 72, an agent ejection data storage 74, an agent ejection data creating unit 76, an agent ejection data modifying unit 78, a conveyer controller 80, a liquid conveyer controller 82, and a remaining amount detector unit 84, in the controller unit 30.

The head controller 70 includes an ink-jet head controller 70*a*, which controls the actuators in the ink-jet head 20*a* according to image data stored in the image data storage 72, and an agent-jet head controller 70*b*, which controls the actuators in the agent-jet head 20*b* according to agent ejection data stored in the agent ejection data storage 74. In the present embodiment, the image data stored in the image data storage 72 indicates size of a dot of the ink R1 to be ejected in one unit area on the sheet P in a scale of four, which includes zero (no dot), a small dot, a medium-sized dot, and a large dot. The agent ejection data stored in the agent ejection data storage 74 indicates size of a dot of the process agent R2 to be ejected in the unit area on the sheet P in a scale of four, which includes zero (no dot), a small dot, a medium-sized dot, and a large dot. Therefore, the controller unit 30 can recognize amounts of the ink R1 and the process agent R2 consumed in a printing operation based on the quantities and sizes of the dots being formed according to the image data and the agent ejection data.

The agent ejection data creating unit 76 creates the agent ejection data based on the image data stored in the image data storage 72. The agent ejection data modifying unit 78 modifies the agent ejection data stored in the agent ejection data storage 74 according to information inputted, for example, through the operation panel 86.

The liquid conveyer controller 82 controls the first liquid conveyers 26*a*, 26*b* and the second liquid conveyers 28*a*, 28*b*. The liquid conveyer controller 82 collects information concerning behaviors of the switch valves 62*a*, 62*b*, the pumps 64*a*, 64*b*, and the pumps 65*a*, 65*b*, and based of the information collected by the liquid conveyer controller 82, the controller unit 30 can recognize amounts of the ink R1 and the process agent R2 conveyed by the first liquid conveyers 26*a*, 26*b* and the second liquid conveyer 28*a*, 28*b* based on the information collected from the switch valves 62*a*, 62*b*, the pumps 64*a*, 64*b*, and the pumps 65*a*, 65*b* such as capacities and operating lengths of time of the pumps 64*a*, 64*b*, and the pumps 65*a*, 65*b*.

The remaining amount detector unit 84 and the upper level sensors 35*a*, 35*b* serve to detect remaining amounts of the ink R1 and the process agent R2 in the liquid tanks 14*a*, 14*b*. That is, when the first liquid conveyers 26*a*, 26*b* are activated for a predetermined length of time period to convey the ink R1 and the process agent R2 to the subsidiary tanks 23*a*, 23*b*, but the upper limit sensors 35*a*, 35*b* do not sense the ink R1 and the process agent R2 in the subsidiary tanks 23*a*, 23*b*, it is assumed that the liquid tanks 14*a*, 14*b* do not contain remaining liquids therein. In this regard, the remaining amount detector unit 84 outputs signals indicating that the remaining amount of the liquids in the liquid tanks 14*a*, 14*b* are smaller than a first predetermined amount.

Further, the remaining amount detector unit 84, the upper level sensors 35*a*, 35*b*, and the lower level sensors 37*a*, 37*b* serve to detect remaining amounts of the ink R1 and the process agent R2 in the subsidiary tanks 23*a*, 23*b*. More specifically, the remaining amount detector unit 84 detects the remaining amounts of the ink R1 and the process agent R2 in the subsidiary tanks 23*a*, 23*b* being at a highest monitorable level, i.e., a maximum permitted amount, based on the signals from the upper level sensors 35*a*, 35*b* and being at a lowest monitorable level, i.e., a minimum permitted amount, based on the signals from the lower level sensors 37*a*, 37*b*. Further, based on the signals from the upper level sensors 35*a*, 35*b*, and the lower level sensors 37*a*, 37*b*, the amounts of the ink R1 and the process agent R2 in the subsidiary tanks 23*a*, 23*b* are maintained within a range between the maximum permitted amount and the minimum permitted amount as long as there are the ink R1 and the process agent R2 remaining in the liquid tanks 14*a*, 14*b* respectively. In this regard, the liquid capacity in the subsidiary tanks 23*a*, 23*b* may not necessarily be equal to the maximum permitted amount, but the subsidiary tanks 23*a*, 23*b* may contain a greater amount of the liquid R1/R2 exceeding the maximum permitted amount.

The operation panel 86 provides an interface for entering information from a user and for notifying the user of various information concerning the printing operation. In the present embodiment, information to be inputted in the agent ejection data modifying unit 78 and the remaining amount detector unit 84 is entered through the operation panel 86, and information to notify the user that the liquid cartridge 16 should be replaced with a new one based on the signals from the remaining amount detector unit 84 is output through the operation panel 86. When the remaining amount detector unit 84 detects that one of the remaining amounts of the ink R1 and the process agent R2 in the liquid tank 14*a* or 14*b* becomes smaller than the first predetermined amount, after the other of the ink R1 and the process agent R2 remaining in the liquid tank 14*a* or 14*b* is transferred to the subsidiary tank 23*a* or 23*b*, the operation panel 86 activates an indication (e.g., displays a message) representing that the liquid cartridge 16 can be replaced with a new one.

Controlling Behaviors of the Controller Unit

Behaviors of the controller unit 30 to control the first liquid conveyers 26*a*, 26*b* and the second liquid conveyers 28*a*, 28*b* to transfer the liquids R1, R2 will be described below with reference to FIGS. 5 and 6. In a controlling flow illustrated in FIGS. 5 and 6, one of the liquids R1, R2 is transferred from one of the liquid tanks 14*a*, 14*b* to one of the subsidiary tanks 23*a*, 23*b* and from the one of the liquid tanks 14*a*, 14*b* to one of the reserve tanks 24*a*, 24*b*.

The flow runs in parallel with a printing operation of the ink-jet printer 10. Whilst the printing operation is running, in S1, a regular liquid-conveying operation is performed. That is, the liquids R1, R2, which are the ink R1 in the liquid tank 14*a* and the process agent R2 in the liquid tank 14*b*, are conveyed to the subsidiary tanks 23*a*, 23*b* by the first liquid conveyers 26*a*, 26*b*. Further, the ink R1 and the process agent R2 in the subsidiary tanks 23*a*, 23*b* are forwarded from the subsidiary tanks 23*a*, 23*b* to the ink-jet head 20*a* and the agent-jet head 20*b* respectively by utilizing an effect of hydraulic head difference. Whilst the remaining amounts of the liquids R1, R2 in the liquid tanks 14*a*, 14*b* are both greater than or equal to the first predetermined amount, the first liquid conveyers 26*a*, 26*b* keep conveying the liquids R1, R2 to the subsidiary tanks 23*a*, 23*b*. In this regard, the controller unit 30 controls the first liquid conveyers 26*a*, 26*b* to maintain the remaining amounts of the ink R1 and the process agent R2 in the subsidiary tanks 23*a*, 23*b* to be smaller than the maximum permitted amount. Thus, the liquids R1, R2 are maintained at the preferable level in the subsidiary tanks 23*a*, 23*b* in the regular liquid-conveying operation (S1) and can be prevented from being excessively supplied or being deteriorated.

Meanwhile, during the printing operation, the ink R1 and the process agent R2 are consumed, and one of the liquids R1, R2 may be exhausted ahead of the other. When one of the liquids R1, R2 is exhausted, exchange of the liquid cartridges 16 is required. In this regard, the other liquid R1 or R2 remaining in the liquid tank 14*a* or 14*b* is transferred to the subsidiary tank 23*a* or 23*b* in steps S3-S13. In the following description, either one of the paired components (e.g., either the liquid tank 14*a* or the liquid tank 14*b*) will be referred to by two reference signs with a "slash(/)" in between them (e.g., the liquid tank 14*a*/14*b*). Further, the other of the paired components will be represented by the two reference sings written in a reversed order with a "slash(/)" in between them (e.g., the liquid tank 14*b*/14*a*).

When the flow starts, in S1, as mentioned above, the liquids R1, R2 are conveyed to the subsidiary tanks 23*a*, 23*b* by the first liquid conveyers 26*a*, 26*b*. In S3, the remaining amounts of the ink R1 and the process agent R2 in the liquid tanks 14*a*, 14*b* are detected by the remaining amount detector unit 84 and based on output signals from the upper level sensor 35*a*, 35*b*. In S5, the controller unit 30 judges as to whether either one of the remaining amounts detected in S3 is lower than the first predetermined amount. If neither one of the remaining amounts detected in S3 is lower than the first predetermined amount (S5: NO), i.e., if both of the remaining amounts of the liquids R1 R2 in the liquid tanks 14*a*, 14*b* are greater than or equal to the first predetermined amount, the flow proceeds to S33. If either one of the remaining amounts of the liquids R1 R2 detected in S3 is smaller than the first predetermined amount (S5: YES), the flow proceeds to S7. According to the present embodiment, when one of the upper level sensors 35*a*, 35*b* does not detect the ink R1 or the process agent R2 after activating the first liquid conveyers 26*a*, 26*b* for a predetermined length of time, the controller unit 30 determines that the remaining amount of one of the ink R1 and the process agent R2 is smaller than the first predetermined amount. In other words, it is assumed that the liquid R1/R2 is fully removed out of the liquid tank 14*a*/4*b* and exhausted. In this regard, one of the ink R1 and the process agent R2, of which remaining amount in the liquid tank 14*a*/14*b* is determined to be smaller than the first predetermined amount, will be referred to as exhausted liquid R1/R2 in the liquid tank 14*a*/14*b*. Meanwhile, the other of the ink R1 and the process agent R2, of which remaining amount in the liquid tank 14*a*/14*b* is determined to be greater than or equal to the first predetermined amount, will be referred to as remaining liquid R2/R1 in the liquid tank 14*b*/14*a*.

In S7, the remaining amount detector unit 84 and the lower level sensors 37*a*, 37*b* detect the remaining amounts of the liquids R1, R2 in the subsidiary tanks 23*a*, 23*b*. The flow proceeds to S9. In S9, the controller unit 30 judges as to whether a remaining amount of the liquid R1/R2, of which remaining amount in the liquid tank 14*a*/14*b* is detected to be smaller than the first predetermined amount, in the subsidiary tank 23*a*/23*b* is smaller than a second predetermined amount. If the remaining amount of the liquid R1/R2, whose remaining amount in the liquid tank 14*a*/14*b* is smaller than the first predetermined amount, in the subsidiary tank 23*a*/23*b* is smaller than the second predetermined amount (S9: YES), the flow proceeds to S11. If the remaining amount of the liquid R1/R2 in the subsidiary tank 23*a*/23*b* is not smaller than the second predetermined amount (S9: NO), the flow proceeds to S33. In this regard, the one of the liquids R1, R2, of which remaining amount in the subsidiary tank 23*a*/23*b* is determined to be smaller than the second predetermined amount, will be referred to as exhausted liquid R1/R2 in the subsidiary tank 23*a*/23*b*, and the other of the liquids R1, R2, of which remaining amount in the subsidiary tank 23*a*/23*b* is determined to be greater than or equal to the second predetermined amount, will be referred to as remaining liquid R2/R1 in the subsidiary tank 23*b*/23*a*.

Figure 5:
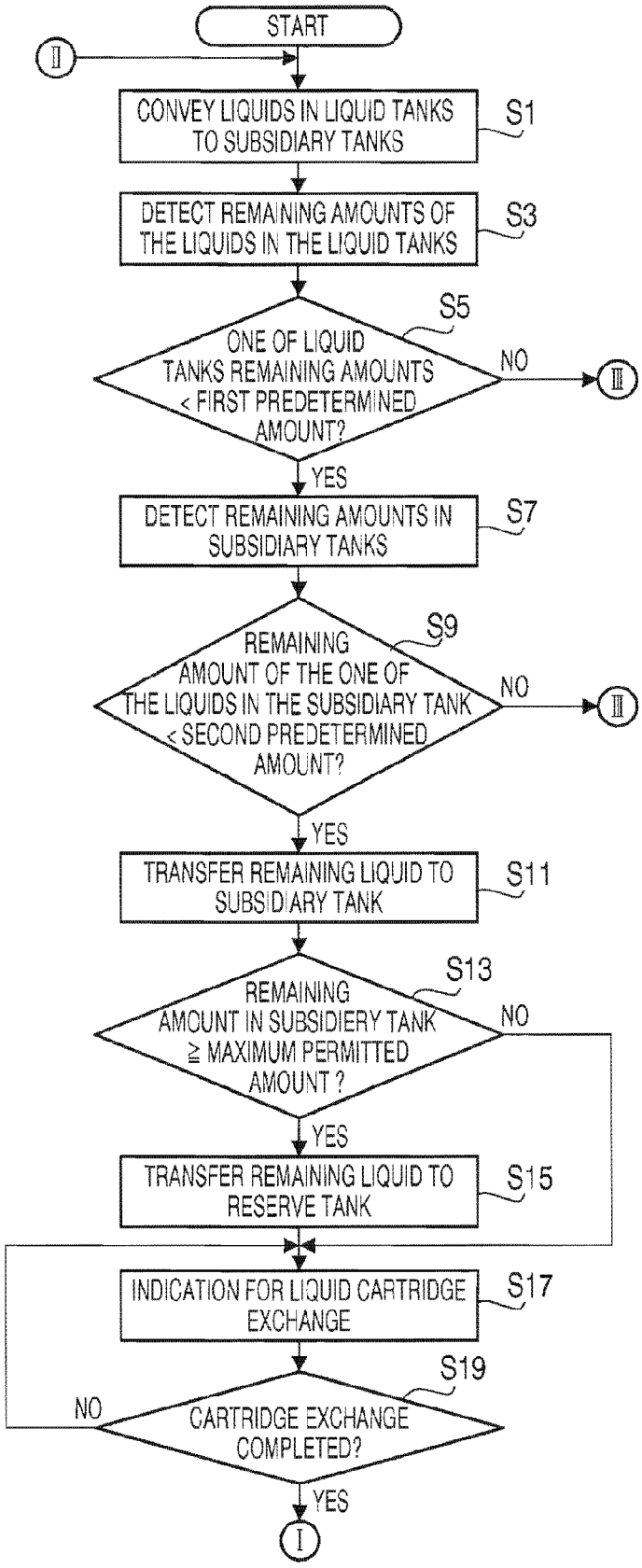
FIG. 5 is a flowchart to illustrate a part of a controlling flow in the ink-jet printer according to the first embodiment of the present invention.
Figure 6:
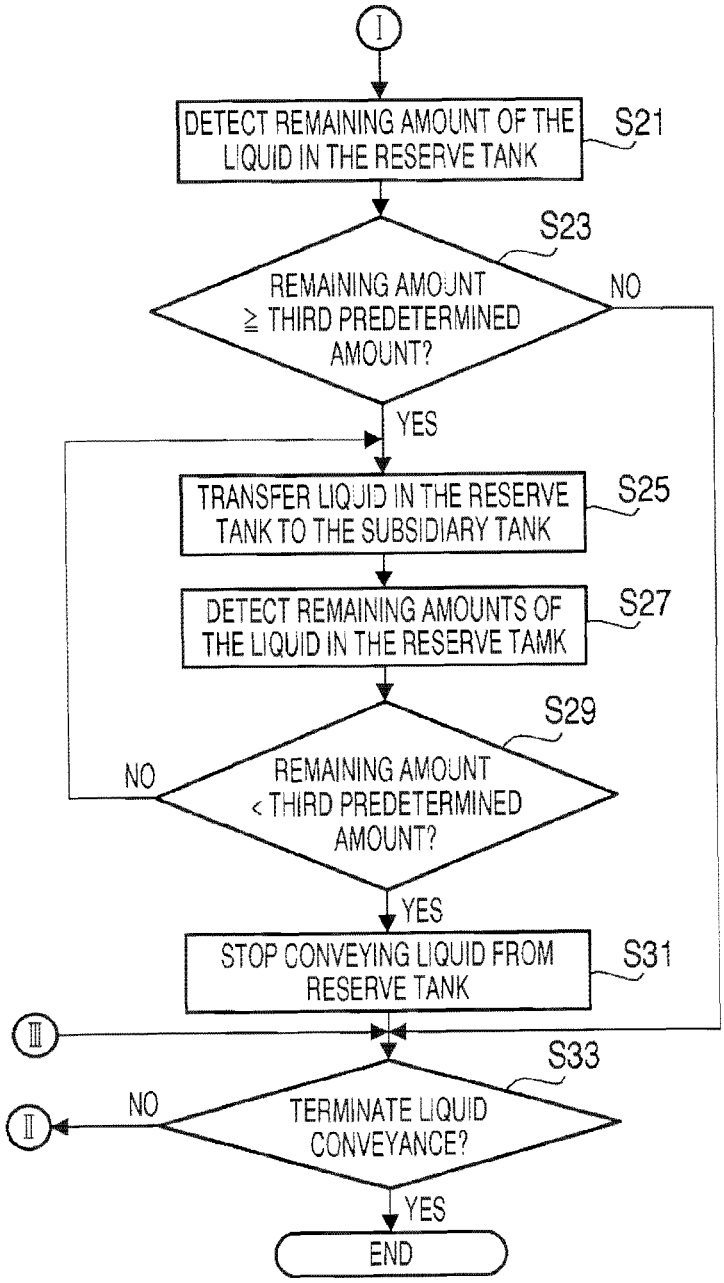
FIG. 6 is a flowchart to illustrate another part of the controlling flow in the ink-jet printer according to the first embodiment of the present invention.

In S11, the printing operation running in parallel with the flow shown in FIG. 5 is suspended. Thus, further consumption of the liquids R1, R2 is stopped. Further, the controller unit 30 manipulates the first liquid conveyer 26*b*/26*a* to transfer the remaining liquid R2/R1 in the liquid tank 14*b*/14*a* to the subsidiary tank 23*b*/23*a* for a predetermined length of time.

In S13, the controller unit 30 judges as to whether the amount of the liquid R2/R1 transferred in the subsidiary tank 23*b*/23*a* is greater than or equal to the maximum permitted amount. When the amount of the liquid R2/R1 in the subsidiary tank 23*b*/23*a* is greater than or equal to the maximum permitted amount (S13: YES), i.e., when the liquid R2/R1 is transferred to fill the subsidiary tank 23*b*/23*a* up to the allowable highest level, it is assumed that the subsidiary tank 23*b*/23*a* is no more acceptable of the liquid R2/R1 from the liquid tank 14*b*/14*a*. The flow proceeds to S15. When the amount of the liquid R2/R1 in the subsidiary tank 23*b*/23*a* is smaller than the maximum permitted amount (S13: NO), the flow proceeds to S17.

In S15, the remaining liquid R2/R1 still remaining in the liquid tank 14*b*/14*a*, which is not more acceptable for the subsidiary tank 23*b*/23*a*, is transferred to the reserve tank 24*b*/24*a* being in communication with the liquid tank 14*b*/14*a* containing the remaining liquid R2/R1. After completion of transferring the liquid R2/R1 from the liquid tank 14*b*/14*a* to the reserve tank 24*b*/24*a*, in S17, the controller unit 30 manipulates the operation panel 86 to activate an indication (e.g., displays a message) to notify the user of need for replacing the liquid cartridge 16 with a new one. After exchanging the liquid cartridges 16, the user may enter information to notify the controller unit 30 of completion of the cartridge exchange through the operation panel 86. Alternatively, the controller unit 30 may automatically detect the liquid cartridges 16 having been exchanged. In S19, the controller unit 30 judges as to whether the liquid cartridges 16 are exchanged. If the liquid cartridges 16 are exchanged (S19: YES), the flow proceeds to S21 (see FIG. 6).

After replacement of the liquid cartridge 16, the suspended printing operation resumes. As the printing operation resumes, the liquids R1, R2 in the subsidiary tanks 23*a*, 23*b* are forwarded to the ink-jet head 20*a* and the agent-jet head 20*b* respectively by the effect of hydraulic head difference. When the liquids R1, R2 in the subsidiary tanks 23*a*, 23*b* are consumed, the amounts remaining in the subsidiary tanks 23*a*, 23*b* become smaller. When the amount of the liquid R2/R1 remaining in the subsidiary tank 23*b*/23*a* becomes smaller than a predetermined amount, the liquid R2/R1 transferred to the reserve tank 24*b*/24*a* in S15 is now transferred to the subsidiary tanks 23*b*/23*a* to be used in the printing operation in S21-S33.

More specifically, in S21, the remaining amount detector unit 84 detects an amount of the liquid R2/R1 remaining in the reserve tank 24*b*/24*a*. In S23, the controller unit 30 judges as to whether the liquid R2/R1 in the reserve tank 24*b*/24*a* is greater than or equal to a third predetermined amount. If the amount of the liquid R2/R1 remaining in the reserve tank 24*b*/24*a* is smaller than the third predetermined amount (S23: NO), the flow proceeds to S33. If the amount of the liquid R2/R1 in the reserve tank 24*b*/24*a* is greater than or equal to the third predetermined amount (S23: YES), the flow proceeds to S25. In S25, the controller unit 30 controls the second liquid conveyers 28*a*, 28*b* to convey the remaining liquid R2/R1 in the reserve tank 24*b*/24*a* to the subsidiary tank 23*b*/23*a*. In S27, the remaining amount detector unit 84 detects the amount of the liquid R2/R1 remaining in the reserve tank 24*b*/24*a*.

In S29, the controller unit 30 judges as to whether the amount of the liquid R2/R1 in the reserve tank 24*b*/24*a* is smaller than the third predetermined amount. If the amount of the liquid R2/R2 remaining in the reserve tank 24*b*/24*b* is greater than or equal to the third predetermined amount (S29: NO), the flow returns to S25. If the amount of the liquid R2/R1 remaining in the reserve tank 24*b*/24*a* is smaller than the third predetermined amount (S29: YES), the flow proceeds to S31. In S31, the controller unit 30 manipulates the second liquid conveyer 28*b*/28*a* for conveying the liquid R2/R1, of which remaining amount is determined to be smaller than the third predetermined amount in S29, to stop conveying the liquid R2/R1 from the reserve tank 24*b*/24*a* to the subsidiary tank 23*b*/23*a*. The flow proceeds to S33. In S33, the controller unit 30 determines as to whether the flow to convey the liquids R1, R2 to the subsidiary tanks 23*a*, 23*b* should be terminated based on the progression of the printing operation. If the flow should not be terminated (S33: NO), the flow returns to S1 and repeats the regular liquid-conveying operation. If the flow should be terminated (S33: YES), the controller unit 30 terminates the flow.

In the above-described flow, the first predetermined amount, the second predetermined amount, and the third predetermined amount are set in advance in order for the liquids R1, R2 to be preferably circulated in the ink-jet printer 10. However, the amounts may be modified by the user, for example, through the operation panel 86.

Effects According to the First Embodiment

According to the first embodiment described above, when the remaining amount detector unit 84 and the upper level sensors 35*a*, 35*b* detect a remaining amount of one of the liquids R1, R2 in the liquid tanks 14*a*, 14*b* being smaller than the first predetermined amount, and when the remaining amount detector unit 84 and the lower level sensors 37*a*, 37*b* detect a remaining amount of the one of the liquids R1/R2 in the subsidiary tank 23*a*/23*b*, which is in communication with the liquid tank 14*a*/14*b* containing the exhausted liquid R1/R1, being smaller than the second predetermined amount, the remaining liquid R2/R1 in the liquid tank 14*b*/14*a* is transferred to the subsidiary tank 23*b*/23*a*, which is in communication with the liquid tank 14*b*/14*a* containing the remaining liquid R2/R1. Therefore, the remaining liquid R2/R1 can be stored in the liquid tank 14*b*/14*a* as long as possible and transferred to the subsidiary tank 23*b*/23*a* at a possibly latest timing. Thus, the liquids R1, R2 in the liquid tanks 14*a*, 14*b* are consumed efficiently. Specifically, one of the liquids R1/R2 remaining in the liquid tank 14*a*/14*b* is consumed without being wasted even when the other of the liquids R2/R1 is exhausted earlier than the remaining liquid R1/R2. Further, the liquids R1, R2 are transferred to the subsidiary tanks 23*a*, 23*b* as much as the transferred liquids R1, R2 reach the maximum permitted amount in the subsidiary tanks 23*a*, 23*b*. Therefore, the volume capacities in the subsidiary tanks 23*a*, 23*b* can be efficiently used to store the liquid R1/R2 remaining in the liquid tank 14*a*/14*b*.

According to the above-described embodiment, the liquid capacity of the reserve tanks 24*a*, 24*b* are equivalent to the liquid capacity of the liquid tanks 14*a*, 14*b* being in communication with the reserve tanks 24*a*, 24*b* respectively. Therefore, when the liquid cartridges 16 are exchanged, the liquid R1/R2 remaining in the liquid tank 14*a*/14*b* is entirely transferred to the subsidiary tanks 23*a*/23*b* and additionally to the reserve tank 24*a*/24*b*. Thus, the remaining liquid R1/R2 is saved in the subsidiary tank 23*a*/23*b* and in the reserve tank 24*a*/24*b*. Therefore, an amount of the remaining liquid R1/R2 to be wasted along with the liquid cartridge 16 can be reduced. Further, whilst the liquid capacity of the subsidiary tanks 23*a*, 23*b* is smaller than the capacities of the liquid tanks 14*a*, 14*b* and the reserve tanks 24*a*, 24*b*, surface areas of the liquids R1, R2 to be exposed to the air in the subsidiary tanks 23*a*, 23*b* are smaller than surface areas of the liquids R1, R2 in the liquid tanks 14*a*, 14*b* or the reserve tanks 24*a*, 24*b*. Accordingly, the liquids R1, R2 can be prevented from being degraded by the air in the subsidiary tanks 23*a*, 23*b* when the liquids R1, R2 are stored in the subsidiary tanks 23*a*, 23*b*.

According to the above-described embodiment, when one of the upper level sensors 35*a*, 35*b* does not detect the ink R1 or the process agent R2 after activating the first liquid conveyers 26*a*, 26*b* for a predetermined length of time, the controller unit 30 determines that the remaining amount of one of the ink R1 and the process agent R2 is exhausted. Therefore, the liquids R1, R2 being exhausted can be detected even without a lower level sensor in the liquid tanks 14*a*, 14*b*, and structures in the liquid tanks 14*a*, 14*b* can be prevented from being complicated but can be simplified.

Second Embodiment

Figure 7:
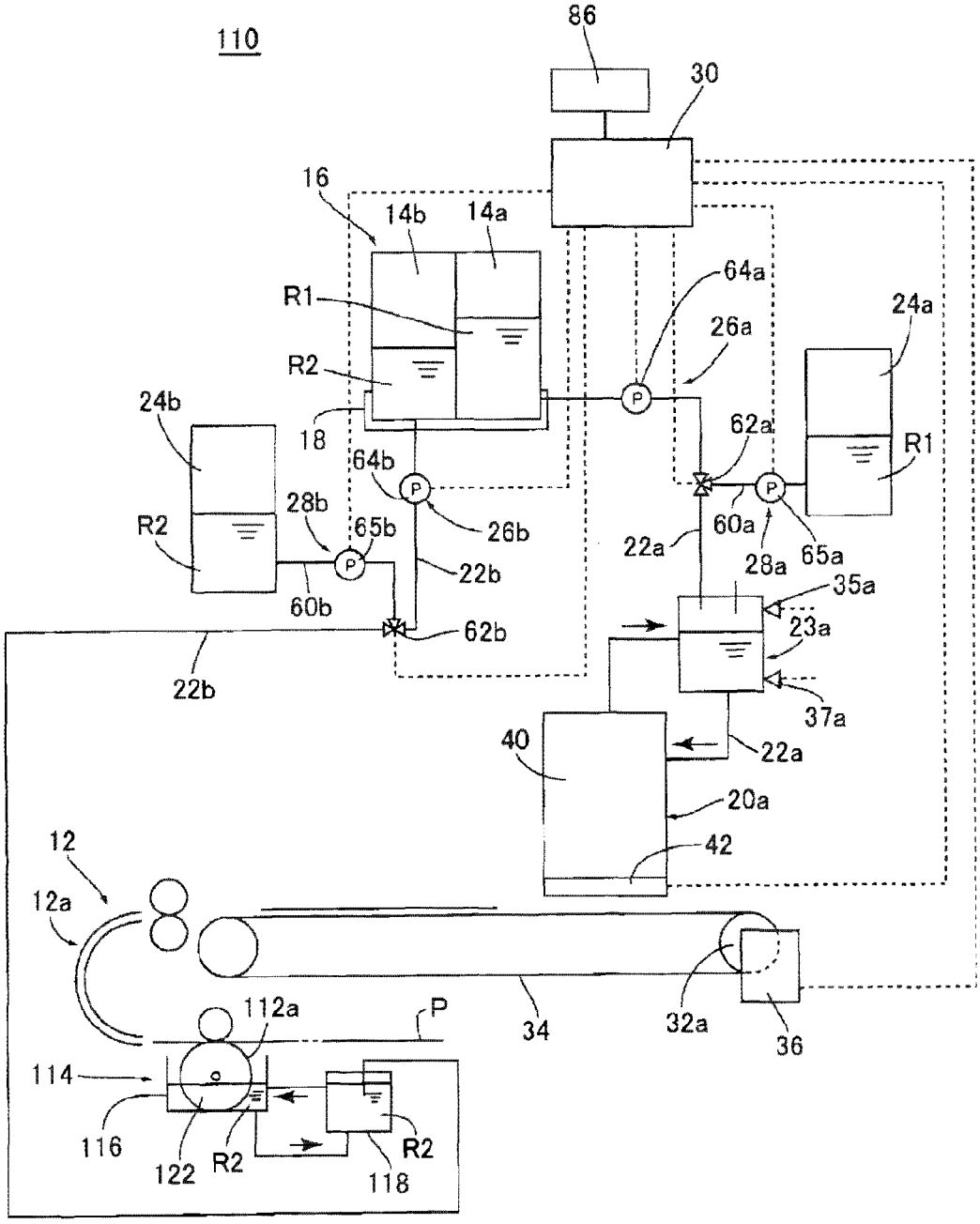
FIG. 7 is a diagram to illustrate an internal configuration of an ink-jet printer according to a second embodiment of the present invention.

A second embodiment of the present invention will be described with reference to FIG. 7. An ink-jet printer 110 according to the second embodiment has liquid tanks 14*a*, 14*b*, which contain a black ink R1 and a process agent R2 to condense or precipitate the black ink R1 respectively. Further, the ink-jet printer 110 has a plurality (e.g., two) of liquid applicators, which are an ink-jet head 20*a* to eject the black ink R1 and a liquid applier 114 with an applier roller 112 to apply the process agent R2 on the surface of the sheet P. The applier roller 112 is rotatably arranged in an agent reservoir 116, which contains the process agent R2. The agent reservoir 116 is connected with a subsidiary tank 118, in which the process agent R2 is temporarily stored. Further, the subsidiary tank 118 is connected with a downstream end of a communication path 22*b*. Therefore, the process agent R2 in the liquid tank 14*b* is conveyed to the agent reservoir 116 via the communication path 22*b* and the subsidiary tank 118. In the agent reservoir 116, the process agent R2 adheres to a peripheral surface of the applier roller 112 and is transferred to be applied to the surface of the sheet P. In this configuration, the conveyer unit 12 has a curved conveyer path 12*a*, on which the sheet P becomes in contact with the peripheral surface 112*a* of the applier roller 112 to have the process agent R2 thereon.

In the above-described configuration, the subsidiary tank 118 serves similarly to the subsidiary tank 23*b* for the process agent R2 in the first embodiment.

Third Embodiment

Figure 8:
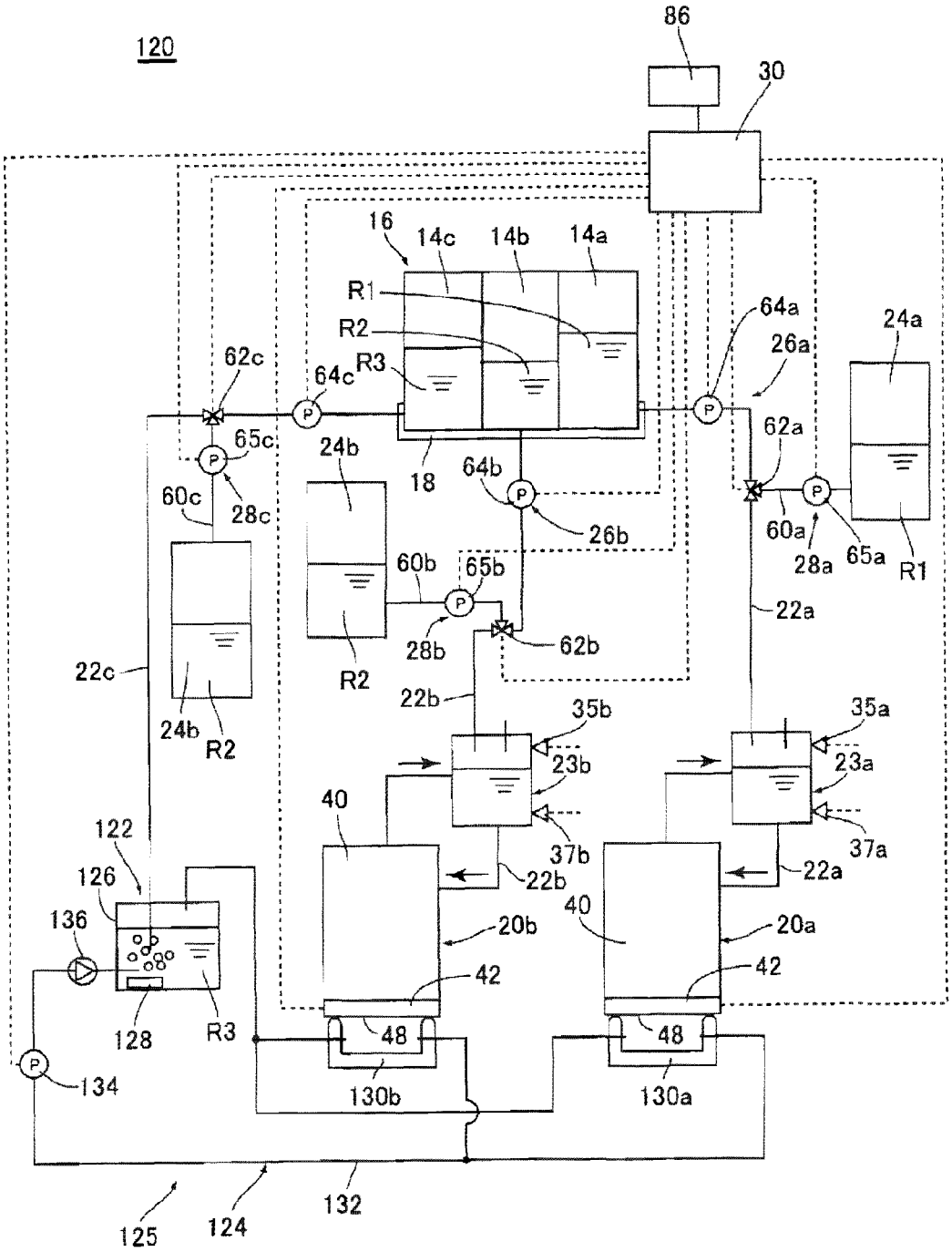
FIG. 8 is a diagram to illustrate an internal configuration of an ink-jet printer according to a third embodiment of the present invention.

A third embodiment of the present invention will be described with reference to FIG. 8. An ink-jet printer 120 according to the third embodiment has a plurality of (e.g., three) liquid tanks 14*a*, 14*b*, 14*c*, which contain an ink R1 a process agent R2, and a humidifying liquid R3 respectively. Further, the ink-jet printer 120 has a plurality (e.g., three) of liquid applicators, which are an ink-jet head 20*a* to eject the ink R1, an agent-jet head 20*b* to eject the process agent R2, and a humidifier 125. The liquid tank 14*c* is configured similarly to the liquid tanks 14*a*, 14*b*, and components similar to those in the liquid tanks 14*a*, 14*b* will be referred to by similar reference sings.

The humidifier 125 includes a vaporizer unit 122, which vaporizes the humidifying liquid R3, and a humidity applier 124, which supplies the vaporized humidifying liquid R3 to the ink-jet head 20*a* and the agent-jet head 20*b*. The vaporizer unit 122 includes a humidifier reservoir 126, in which the humidifying liquid R3 is temporarily stored, and a vaporizer 128 (e.g., an ultrasonic vaporizer) arranged in the humidifier reservoir 126. The humidifier reservoir 126 is connected with a downstream end of a communication path 22*c* and serves similarly to the subsidiary tanks described in the preceding embodiments. The humidifying liquid R3 is conveyed from the liquid tank 14*c* to the humidifier reservoir 126 via the communication path 22*c* and vaporized by the vaporizer 128. Meanwhile, the humidity applier 124 includes caps 130*a*, 130*b*, which cover the nozzle surfaces 48 of the ink-jet head 20*a* and the agent-jet head 20*b* respectively, and a circular vapor path 132, which connects the humidifier reservoir 126 with the cap 130*a* and the cap 130*b*. Further, the humidity applier 124 includes a pump 134 and a one-way valve 136, which are arranged in the vapor path 132. When the controller unit 30 activates the pump 134, the vapor generated in the humidifier reservoir 126 is conveyed in the vapor path 130 and supplied to the caps 130*a*, 130*b*. Thus, the nozzle surfaces 48 are prevented from being dried out, and the nozzles 50 are prevented from being clogged by the ink R1 or the process agent R2.

In the above-described configuration, the humidifier reservoir 126 serves similarly to the subsidiary tanks in the preceding embodiments.

More Examples

Although examples of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in order to detect the amounts of the liquids R1, R2 remaining in the liquid tanks 14*a*, 14*b*, instead of detecting the amounts by using the upper level sensors 35*a*, 35*b* in the subsidiary tanks 23*a*, 23*b*, liquid level sensors may be provided in the liquid tanks 14*a*, 14*b*. For another example, the amounts of the liquids R1, R2 remaining in the liquid tanks 14*a*, 14*b*, and/or the amounts of the liquids R1, R2 remaining in the subsidiary tanks 23*a*, 23*b* may be calculated based on consumed or conveyed amounts of the liquids R1, R2 instead of detecting the amounts by using the upper level sensors 35*a*, 35*b* and/or the lower level sensors 37*a*, 37*b*. That is, for example, the upper level sensors 35*a*, 35*b* may be provided to the subsidiary tanks 23*a*, 23*b*, whilst the lower level sensors 37*a*, 37*b* are omitted. The controller unit 30 may start measuring the consumed or conveyed amounts of the liquids R1, R2 once the amounts of the liquids R1, R2 in the subsidiary tanks 23*a*, 23*b* reach the maximum permitted amounts to be detected by the upper level sensors 35*a*, 35*b*. Thus, the controller unit 30 may judge as to whether the remaining amounts of the liquids in the liquid tanks 14*a*, 14*b* and/or the subsidiary tanks 23*a*, 23*b* reach the minimum permitted amount based on the measured consumed or conveyed amounts of liquids R1, R2. Further, the amounts of the liquids R1, R2 remaining in the liquid tanks 14*a*, 14*b* and/or the subsidiary tanks 23*a*, 23*b* may be achieved by calculation based on the amounts having been conveyed and consumed in the printing operation. The amounts of the liquids R1, R2 having been conveyed and consumed in the printing operation may be achieved by monitoring behaviors of application programs for the printing operation.

For another example, in S11 (FIG. 5), when transfer of the remaining liquid R2/R1 remaining in the liquid tank 14*b*/14*a* is completed within the predetermined length of time, and if completion of transfer of the remaining liquid R2/R1 is detected, the flow may proceed to S17, in which the controller unit 30 manipulates the operation panel 86 to activate the indication to notify the user of need for replacing the liquid cartridge 16 with a new one.

The indication to notify the user of need for replacing the liquid cartridge 16 with a new one may be illumination of a lamp or an audio (e.g., voice) message.

The different liquids R1, R2 may not necessarily be an ink and a process agent but may be a plurality of different-colored inks. For example, the liquid R1 may be a black ink, and the liquid R2 may include inks in different colors, such as cyan, magenta, and yellow.

The image forming apparatus may not necessarily be a printer but may be other image forming device such as a facsimile machine or a copier. Further, the liquid ejection may not necessarily be achieved by the actuators but may be achieved by, for example, thermal pressure. That is, heaters may cause thermal expansion in the liquids so that the liquids are ejected from the nozzles by the expansion.

What is claimed is:

1. An image forming apparatus to form an image in a plurality of different-typed liquids, comprising:

a liquid cartridge, which is configured to have a plurality of integrally-formed liquid tanks to respectively contain the different-typed liquids, the plurality of integrally-formed liquid tanks forming a single liquid cartridge;

a cartridge mount, on which the single liquid cartridge is mounted;

a plurality of liquid applicators, which are configured to apply the different-typed liquids respectively to form the image on a recording medium;

a plurality of communication paths, which are configured to communicably connect the plurality of integrally-formed liquid tanks with the liquid applicators respectively to be in fluid communication with each other;

a subsidiary tank, which is arranged in an intermediate position in one of the communication paths to be communicably connected with one of the integrally-formed liquid tanks, to store one of the different-typed liquids conveyed from the communicably connected liquid tank;

a first remaining amount detector, which is configured to detect amounts of the different-typed liquids remaining in the integrally-formed liquid tanks;

a first liquid conveyer, which is configured to transfer the one of the different-typed liquid from the communicably connected liquid tank to the subsidiary tank; and a first liquid conveyer controller, which is configured to manipulate the first liquid conveyer, wherein, when the first remaining amount detector detects an amount of the one of the different-typed liquids remaining in one of the integrally-formed liquid tanks being smaller than a first predetermined amount, the first liquid conveyer controller manipulates the first liquid conveyer to transfer the other of the different-typed liquids remaining in the other of the integrally-formed liquid tanks, which is communicably connected with the subsidiary tank, to the subsidiary tank; and wherein, when the first remaining amount detector detects the amount of the one of the different-typed liquids remaining in the one of the integrally-formed liquid tanks being greater than or equal to the first predetermined amount, the first liquid conveyer controller manipulates the first liquid conveyer to transfer the one of the different-typed liquids from the communicably connected liquid tank to the subsidiary tank in an amount up to an upper limit level for the subsidiary tank.

2. The image forming apparatus according to claim 1, wherein the different-typed liquids to be contained in the integrally-formed liquid tanks include a black ink and a different-colored ink other than black; and wherein the liquid applicators include an ink-jet head for the black ink and an ink-jet head for the different-colored ink.

3. The image forming apparatus according to claim 1, wherein the different-typed liquids to be contained in the integrally-formed liquid tanks include a black ink and a process agent to cause components in the black ink to one of condense and precipitate; and wherein the liquid applicators include an ink-jet head for the black ink and an agent-jet head for the process agent.

4. The image forming apparatus according to claim 1, wherein the different-typed liquids to be contained in the integrally-formed liquid tanks include a black ink and a process agent to cause components in the black ink to one of condense and precipitate; and wherein the liquid applicators include an ink jet head for the black ink and a liquid applier having an applier roller, the applier roller applying the process agent on a surface of the recording medium.

5. The image forming apparatus according to claim 1, wherein the different-typed liquids to be contained in the integrally-formed liquid tanks include an ink and a humidifying liquid; and wherein the liquid applicators include an ink jet head for the ink, a vaporizer to vaporize the humidifying liquid, and a humidity applier to supply the vaporized humidifying liquid to the ink-jet head.

6. The image forming apparatus according to claim 1, wherein the subsidiary tank includes a plurality of subsidiary tanks, which are in fluid communication with the integrally-formed liquid tanks to store the different-typed liquids respectively;

wherein the image forming apparatus further comprises a second remaining amount detector, which is configured to detect amounts of the different-typed liquids stored in the subsidiary tanks, wherein, when the first remaining amount detector detects the amount of the one of the different-typed liquids remaining in the one of the integrally-formed liquid tanks being smaller than the first predetermined amount, and when the second remaining amount detector detects the amount of the one of the different-typed liquids remaining in one of the subsidiary tanks communicably connected with the one of the integrally-formed liquid tanks being smaller than a second predetermined amount, the first liquid conveyer controller manipulates the first liquid conveyer to transfer the other of the different-typed liquids remaining in the other of the integrally-formed liquid tanks, which is communicably connected with the other of the subsidiary tanks, to the other of the subsidiary tanks.

7. The image forming apparatus according to claim 6, wherein the first remaining amount detector includes:

an upper level sensor, which is configured to detect the amount of the one of the different-typed liquids in the one of the subsidiary tanks reaching the upper limit level for the subsidiary tanks; and an output unit, which is configured to output signals indicating the one of the different-typed liquids in the one of the integrally-formed liquid tanks is fully removed when the upper level sensor fails to detect the amount of the one of the different-typed liquids reaching the upper limit level in the one of the subsidiary tanks after the first liquid conveyer is activated for a predetermined length of time.

8. The image forming apparatus according to claim 1, wherein, when the first remaining amount detector detects the amount of the one of the different-typed liquids remaining in the one of the integrally-formed liquid tanks being smaller than the first predetermined amount, the first liquid conveyer controller manipulates the first liquid conveyer to transfer the other of the different-typed liquids remaining in the other of the integrally-formed liquid tanks, which is communicably connected with the subsidiary tank, to the subsidiary tank up to the upper limit level for the subsidiary tank.

9. The image forming apparatus according to claim 8, wherein, when the first remaining amount detector detects the amount of each of the different-typed liquids remaining in each of the integrally-formed liquid tanks being one of greater than and equal to the first predetermined amount, the first liquid conveyer controller manipulates the first liquid conveyer to maintain the amount of the different-typed liquid in the subsidiary tank to be smaller than the upper limit level.

10. The image forming apparatus according to claim 1, further comprising a notifying unit to notify a user that the single liquid cartridge needs to be exchanged when the first remaining amount detector detects the amount of the one of the different-typed liquids remaining in the one of the integrally-formed liquid tanks being smaller than the first predetermined amount.

11. The image forming apparatus according to claim 10, wherein the notifying unit notifies the user that the single liquid cartridge needs to be exchanged when conveyance of the other of the different-typed liquids remaining in the other of the integrally-formed liquid tanks is completed.

12. The image forming apparatus according to claim 1, wherein the first remaining amount detector detects the amount of the one of the different-typed liquids remaining in the one of the integrally-formed liquid tanks being smaller than the first predetermined amount after the first liquid conveyer controller manipulates the first liquid conveyor to transfer the one of the different-typed liquids from the one of the integrally-formed liquid tanks to the communicably connected subsidiary tank for a predetermined length of time.

13. The image forming apparatus according to claim 12, wherein the first predetermined amount is an amount for the one of the different-typed liquids remaining in the one of the integrally-formed liquid tanks to be fully transferred from the one of the integrally-formed liquid tanks to the communicably connected subsidiary tank after the first liquid conveyor is manipulated for the predetermined length of time to transfer the one of the different-typed liquids from the one of the liquid tanks to the communicably connected subsidiary tank.

14. An image forming apparatus comprising:

a liquid cartridge, which is configured to have a plurality of liquid tanks to respectively contain different-typed liquids;

a cartridge mount, on which the liquid cartridge is mounted;

a plurality of liquid applicators, which are configured to apply the different-typed liquids respectively to form an image on a recording medium;

a plurality of communication paths, which are configured to communicably connect the liquid tanks with the liquid applicators respectively to be in fluid communication with each other;

a subsidiary tank, which is arranged in an intermediate position in one of the communication paths to be communicably connected with one of the liquid tanks, to store one of the different-typed liquids conveyed from the communicably connected liquid tank;

a first remaining amount detector, which is configured to detect amounts of the different-typed liquids remaining in the liquid tanks;

a first liquid conveyer, which is configured to transfer the one of the different-typed liquid from the communicably connected liquid tank to the subsidiar tank;

a first liquid conveyer controller, which is configured to manipulate the first liquid conveyer;

a reserve tank, which is communicably connected with at least one of the communication paths via a branch path to be in fluid communication with the other of the liquid tanks being communicably connected with the subsidiary tank;

a second liquid conveyer, which is configured to transfer the other of the different-typed liquids remaining in the other of the liquid tanks being communicably connected with the subsidiary tank to the reserve tank; and a second liquid conveyer controller, which is configured to manipulate the second liquid conveyer, wherein, when the first remaining amount detector detects an amount of the one of the different-typed liquids remaining in one of the liquid tanks being smaller than a first predetermined amount, the first liquid conveyer controller manipulates the first liquid conveyer to transfer the other of the different-typed liquids remaining in the other of the liquid tanks, which is communicably connected with the subsidiary tank, to the subsidiary tank;

wherein the subsidiary tank includes a plurality of subsidiary tanks, which are in fluid communication with the liquid tanks to store the different-typed liquids respectively;

wherein the image forming apparatus further comprises a second remaining amount detector, which is configured to detect amounts of the different-typed liquids stored in the subsidiary tanks;

wherein, when the first remaining amount detector detects the amount of the one of the different-typed liquids remaining in the one of the liquid tanks being smaller than the first predetermined amount, and when the second remaining amount detector detects the amount of the one of the different-typed liquids remaining in one of the subsidiary tanks communicably connected with the one of the liquid tanks being smaller than a second predetermined amount, the first liquid conveyer controller manipulates the first liquid conveyer to transfer the other of the different-typed liquids remaining in the one of the liquid tanks, which is communicably connected with the other of the subsidiary tanks, to the other of the subsidiary tanks; and wherein, when the second remaining amount detector detects the amount of the other of the different-typed liquids transferred in the subsidiary tank reaching an upper limit for the subsidiary tank, the second liquid conveyer controller manipulates the second liquid conveyer to transfer the other of the different-typed liquids remaining in the other of the liquid tanks communicably connected with the subsidiary tank to the reserve tank.

15. The image forming apparatus according to claim 14, wherein liquid capacity of the subsidiary tank is smaller than liquid capacity of the liquid tanks; and wherein liquid capacity of the reserve tank is equivalent to the liquid capacity of the liquid tanks.

16. An image forming apparatus to form an image in a plurality of different-typed liquids, comprising:

a liquid cartridge, which is configured to have a plurality of integrally-formed liquid tanks to respectively contain the different-typed liquids, the plurality of integrally-formed liquid tanks forming a single liquid cartridge;

a cartridge mount, on which the single liquid cartridge is mounted;

a plurality of liquid applicators, which are configured to apply the different-typed liquids respectively to form the image on a recording medium;

a plurality of communication paths, which are configured to communicably connect the integrally-formed liquid tanks with the liquid applicators respectively to be in fluid communication with each other;

a subsidiary tank, which is arranged in an intermediate position in one of the communication paths to be communicably connected with one of the integrally-formed liquid tanks, to store one of the different-typed liquids conveyed from the communicably connected liquid tank;

a first remaining amount detector, which is configured to detect amounts of the different-typed liquids remaining in the liquid tanks;

a first liquid conveyer, which is configured to transfer the one of the different-typed liquid from the communicably connected liquid tank to the subsidiary tank;

a processor, which is configured to control behaviors of the image forming apparatus; and a memory containing instructions, which cause the processor to function, when executed by the processor, as:

a first liquid conveyer controller, which is configured to manipulate the first liquid conveyer, wherein, when the first remaining amount detector detects an amount of the one of the different-typed liquids remaining in one of the integrally-formed liquid tanks being smaller than a first predetermined amount, the first liquid conveyer controller manipulates the first liquid conveyer to transfer the other of the different-typed liquids remaining in the other of the integrally-formed liquid tanks, which is communicably connected with the subsidiary tank, to the subsidiary tank; and wherein, when the first remaining amount detector detects the amount of the one of the different-typed liquids remaining in the one of the integrally-formed liquid tanks being greater than or equal to the first predetermined amount, the first liquid conveyer controller manipulates the first liquid conveyer to transfer the one of the different-typed liquids from the communicably connected liquid tank to the subsidiary tank in an amount up to an upper limit level for the subsidiary tank.

* * * * *